US011565388B2

(12) United States Patent
Hsieh

(10) Patent No.: US 11,565,388 B2
(45) Date of Patent: Jan. 31, 2023

(54) SETTING METHOD FOR ELECTRONIC TORQUE TOOL

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 574 days.

(21) Appl. No.: 16/703,840

(22) Filed: Dec. 4, 2019

(65) Prior Publication Data

US 2020/0180127 A1 Jun. 11, 2020

(30) Foreign Application Priority Data

Dec. 6, 2018 (TW) ..... 107143977

(51) Int. Cl.
*B25B 23/00* (2006.01)
*B25B 23/142* (2006.01)

(52) U.S. Cl.
CPC ..... *B25B 23/1425* (2013.01)

(58) Field of Classification Search
CPC . B25B 23/00; B25B 23/0057; B25B 23/0078; B25B 23/14; B25B 23/1405; B25B 23/1425
See application file for complete search history.

(56) References Cited

U.S. PATENT DOCUMENTS 8,485,075 B1 * 7/2013 Gauthier ..... B25B 23/1425 81/479
2007/0095155 A1 * 5/2007 Rainone ..... B25B 23/1427 73/862.22
2011/0132158 A1 * 6/2011 Wener ..... B25B 23/1427 81/479
2014/0069211 A1 * 3/2014 Backhaus ..... B25B 23/1425 73/862.23
2014/0165796 A1 * 6/2014 Gauthier ..... B25H 3/006 81/479
2020/0180126 A1 * 6/2020 Hsieh ..... B25B 23/1425
2020/0180127 A1 * 6/2020 Hsieh ..... B25B 23/1425
2020/0400525 A1 * 12/2020 King ..... B25B 13/463

* cited by examiner

*Primary Examiner* — Lee D Wilson
(74) *Attorney, Agent, or Firm* — Guice Patents PLLC

(57) ABSTRACT

A setting method for an electronic torque tool is disclosed. The electronic torque tool includes a tool body that stores at least one operation set. The operation set includes at least one adjustable operation parameter of the electronic torque tool. The setting method can be used to adjust the operation parameter in the operation set and includes a setting step and a storing step. The setting step includes entering the operation set and adjusting the operation parameter therein. The storing step includes storing the adjusted operation parameter in the operation set directly after an operator quits the operation set or turns off the electronic torque tool during the setting step. The setting method allows the operation parameter in the operation set to be easily and rapidly set or adjusted, thereby making the electronic torque tool easy to use and operate.

11 Claims, 6 Drawing Sheets

SETTING METHOD FOR ELECTRONIC TORQUE TOOL

BACKGROUND OF THE INVENTION

1. Technical Field

The present invention relates to an electronic torque tool and more particularly to a setting method for an electronic torque tool, wherein the setting method allows the operation parameters of the tool to be easily changed and stored.

2. Description of Related Art

Nowadays, an electronic torque wrench generally has a number of preset operation sets, each including a user-specifiable series of frequently used operation parameters such as the magnitude of the torque to be applied, the unit of measurement of the torque value, and the available operation modes so that, before operating the wrench, a user can rapidly select a suitable one of the pre-stored operation sets according to the workpiece to work on.

The preset operation sets not only enable easy selection, but also allow the user-specified operation parameters to be adjusted and new operation parameters (e.g., a new torque value) to be set if the existing operation parameters do not meet the needs of an intended application. To adjust the operation parameters in an operation set of a conventional electronic torque wrench, the user is generally required to do the following. Referring to FIG. 8, the first step is to activate the setting interface and select the setting mode a. Once the setting mode a is selected, the user will be requested to confirm whether the operation sets are to be changed and whether the user intends to change the pre-stored operation parameters in the operation sets or add a new operation set. After that, the user must select the adjustment mode b in order to adjust, for example, the minimum torque value and then the maximum torque value in a specific operation set, followed sequentially by the remaining operation parameters in that set (e.g., the number of times of torque application and the unit of measurement of the torque values). While in the adjustment mode b, it is required that all the operation parameters in the set be selected one after another. Even if a certain operation parameter need not be changed, the user still has to enter and then quit the setting screen of that operation parameter, or the next operation parameter cannot be selected. Only after the user sets all the operation parameters in that set will the adjustment mode b be completed and the storage option c be subsequently shown, requesting the user to confirm whether the operation parameters changed or added during the adjustment mode b should be stored to replace the original contents, or as the user-specified contents, of the operation set. Once the storing step is completed, the operation interface is shown again so that, if the user wishes to change another operation set, the user can select the intended operation set through the operation interface. It can be known from the above that the conventional procedure for adjusting the operation parameters in an operation set is rather complicated. In particular, the user must complete the setting process of every operation parameter in an operation set in order for the storing step to begin; that is to say, the storing step will not be performed until all the operation parameters in the set have been set, regardless of whether the operation parameters need to be changed in their entirety. The conventional electronic torque wrenches, therefore, are inconvenient in terms of setting and use.

BRIEF SUMMARY OF THE INVENTION

The primary objective of the present invention is to provide a setting method for an electronic torque tool, wherein the setting method allows the operation parameters in the operation sets of the torque tool to be rapidly changed, adjusted, and stored.

The secondary objective of the present invention is to provide a setting method for an electronic torque tool, wherein the setting method allows an operation parameter in an operation set to be stored immediately and directly after it is adjusted or set.

To achieve the foregoing objectives, the present invention provides a setting method for an electronic torque tool. The electronic torque tool comprises a tool body, the tool body stores at least one operation set:

the at least one operation set that includes least one adjustable operation parameter of the electronic torque tool;

the setting method can be used to adjust the operation parameter in the operation set that includes a setting step and a storing step;

the setting step includes entering the operation set and adjusting the operation parameter in the operation set;

the storing step includes storing the adjusted operation parameter in the operation set directly when an operator quits the operation set or turns off the tool body during the setting step.

Preferably, the operation parameter changed in the setting step is a torque value.

Preferably, the operation parameter changed in the setting step is the value of a rotation angle.

Preferably, the operation parameter changed in the setting step is the value of the rotation angle of a rotating operation to be performed when a torque value is reached, wherein both the torque value and the value of the rotation angle can be set.

The setting method for the electronic torque tool is so designed that the operation parameter in the operation set can be adjusted through the setting step in the operation set, and that the storing step can be carried out during the setting step to directly (automatically) store the adjusted operation parameter in the operation set immediately after the adjustment. The setting method allows the operation parameter in the operation set to be adjusted and stored in a simple and instantaneous manner, thereby reducing the complexity of the electronic torque tool in terms of use.

BRIEF DESCRIPTION OF THE SEVERAL VIEWS OF THE DRAWINGS

The objectives, features, and intended effects of the present invention can be better understood by referring to the following detailed description of a preferred embodiment of the invention in conjunction with the accompanying drawings, in which.

DETAILED DESCRIPTION OF THE INVENTION

Figure 1:
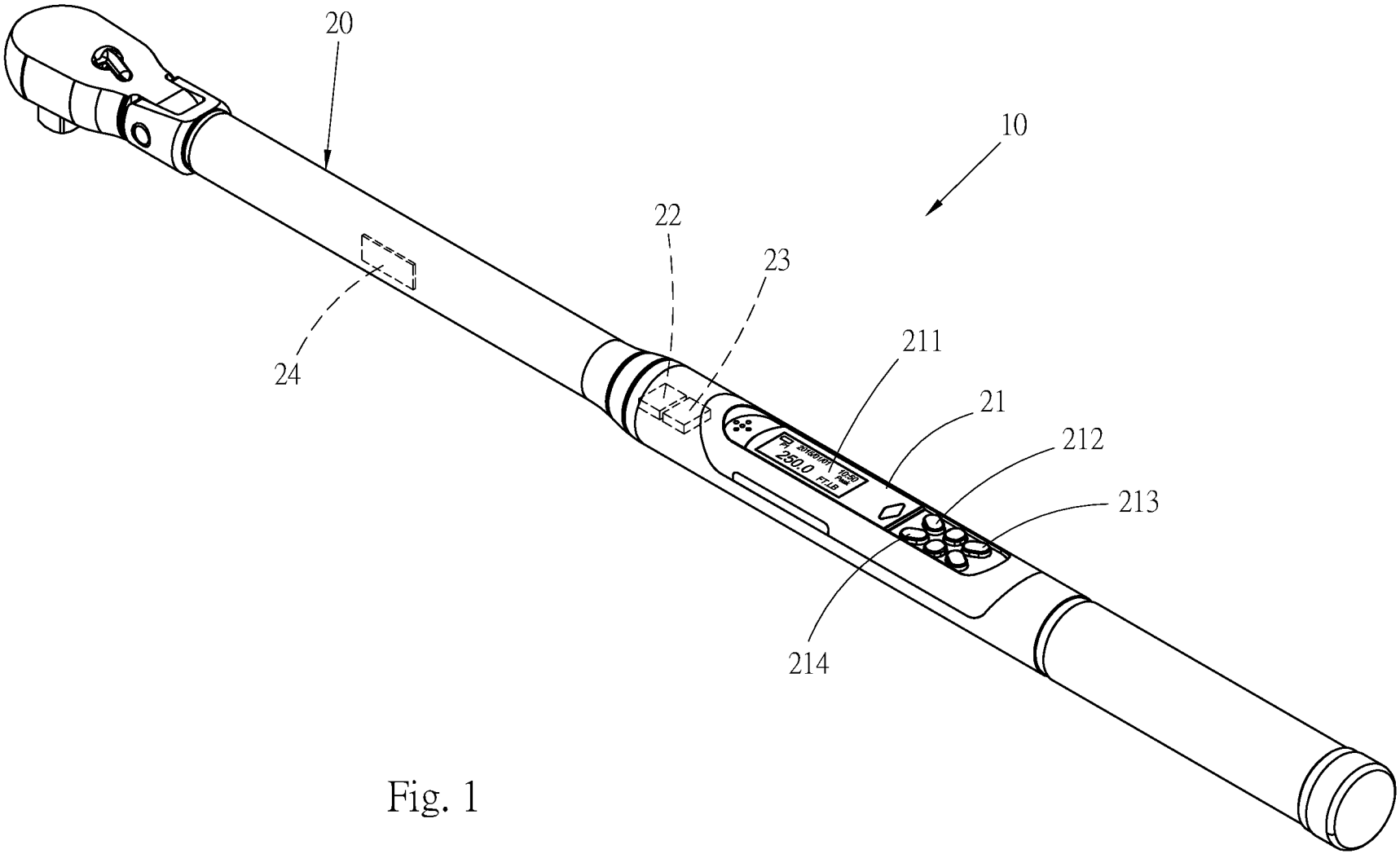
FIG. 1 is a perspective view of the electronic torque tool according to a preferred embodiment of the invention.
Figure 2:
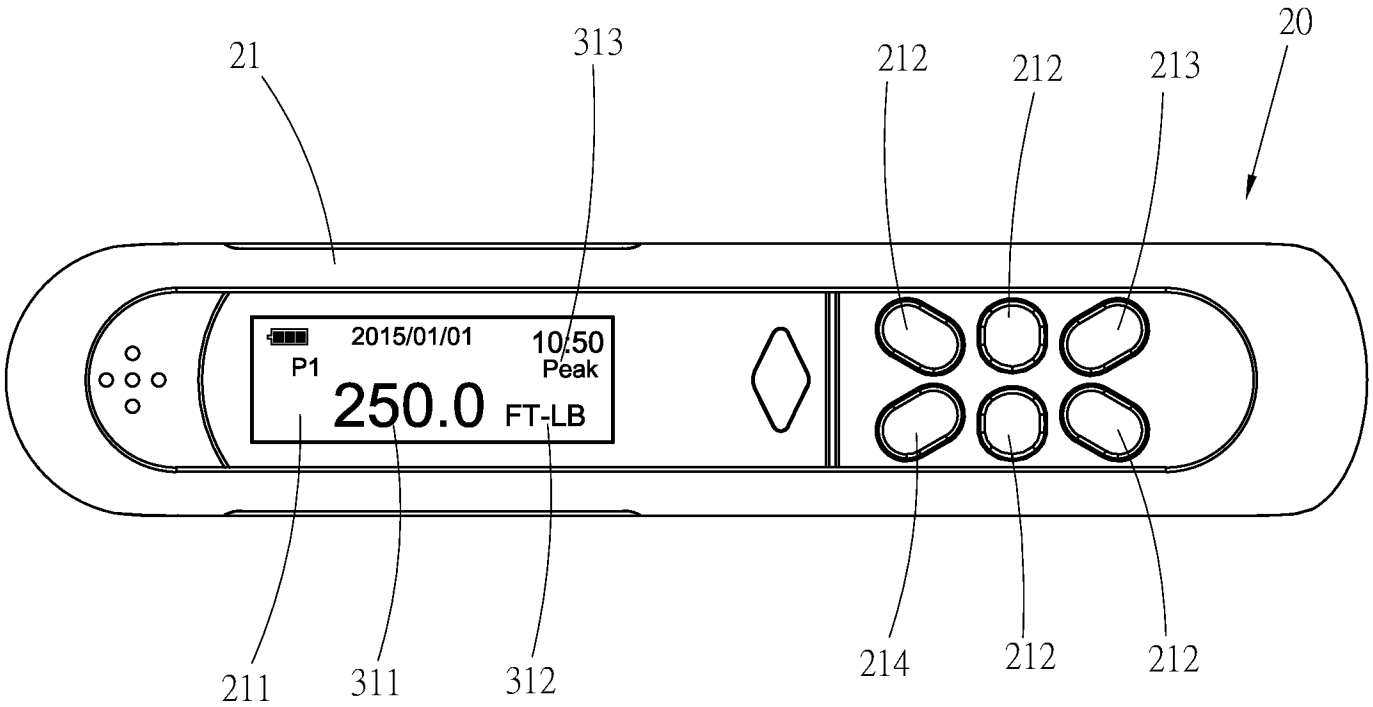
FIG. 2 shows the configuration of the operation panel of the electronic torque tool in FIG. 1.

The present invention provides a method for setting an electronic torque tool, or more particularly for setting and adjusting the operation parameters of the torque tool, wherein the operation parameters may include, for example, torque values, the rotation angle value of each rotating operation of the torque tool, and the rotation angle value of each rotating operation to be performed by the torque tool when a predetermined torque value is reached (hereinafter referred to as a torque-then-angle rotation angle value). FIG. 1 and FIG. 2 show the torque tool 10 according to a preferred embodiment of the invention. The torque tool 10 includes a tool body 20, an operation panel 21 provided on the tool body 20, a display screen 211 provided on the operation panel 21, and a plurality of buttons (e.g., four setting buttons 212, a set button 213, and a power on/off button 214) provided on the operation panel 21. Disposed in the tool body 20 are a processing unit 22, a memory unit 23, and a sensing unit 24. The processing unit 22 is configured to receive the settings input through the operation panel 21 and the values sensed by the sensing unit 24. The sensing unit 24 is configured to sense the magnitudes (or values) of the torques applied to the tool body 20, the rotation angle value of each rotating operation of the torque tool, and each torque-then-angle rotation angle value and send the sensed values to the processing unit 22 for processing and to the memory unit 23 for storage.

Figure 3:
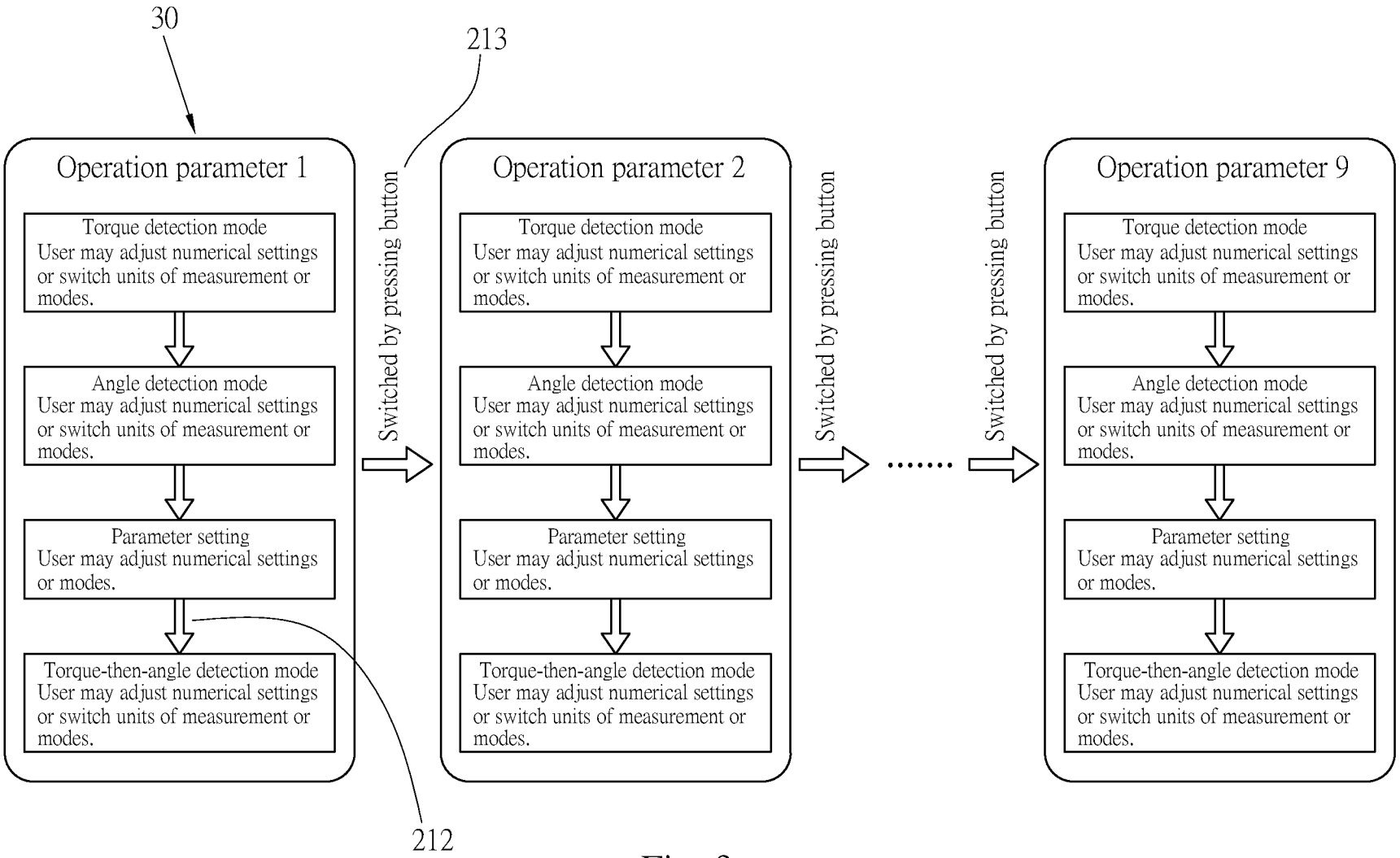
FIG. 3 is a flowchart showing how operation sets are switched from one to another according to the invention.
Figure 7:
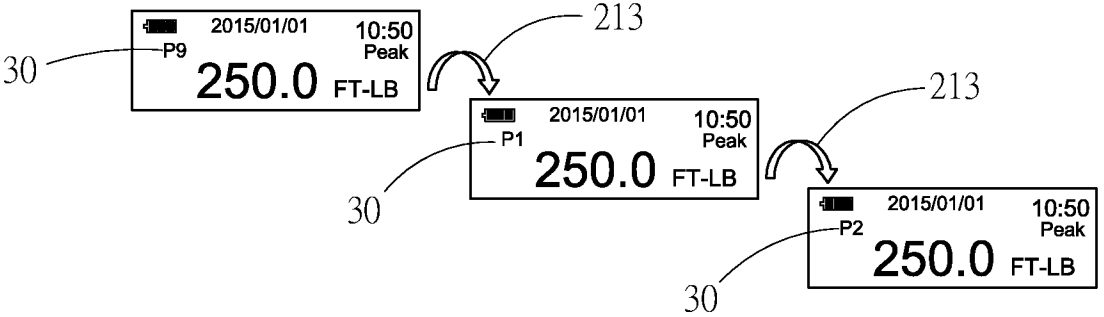
FIG. 7 shows the operations of switching one operation set to another according to the invention.
Figure 8:
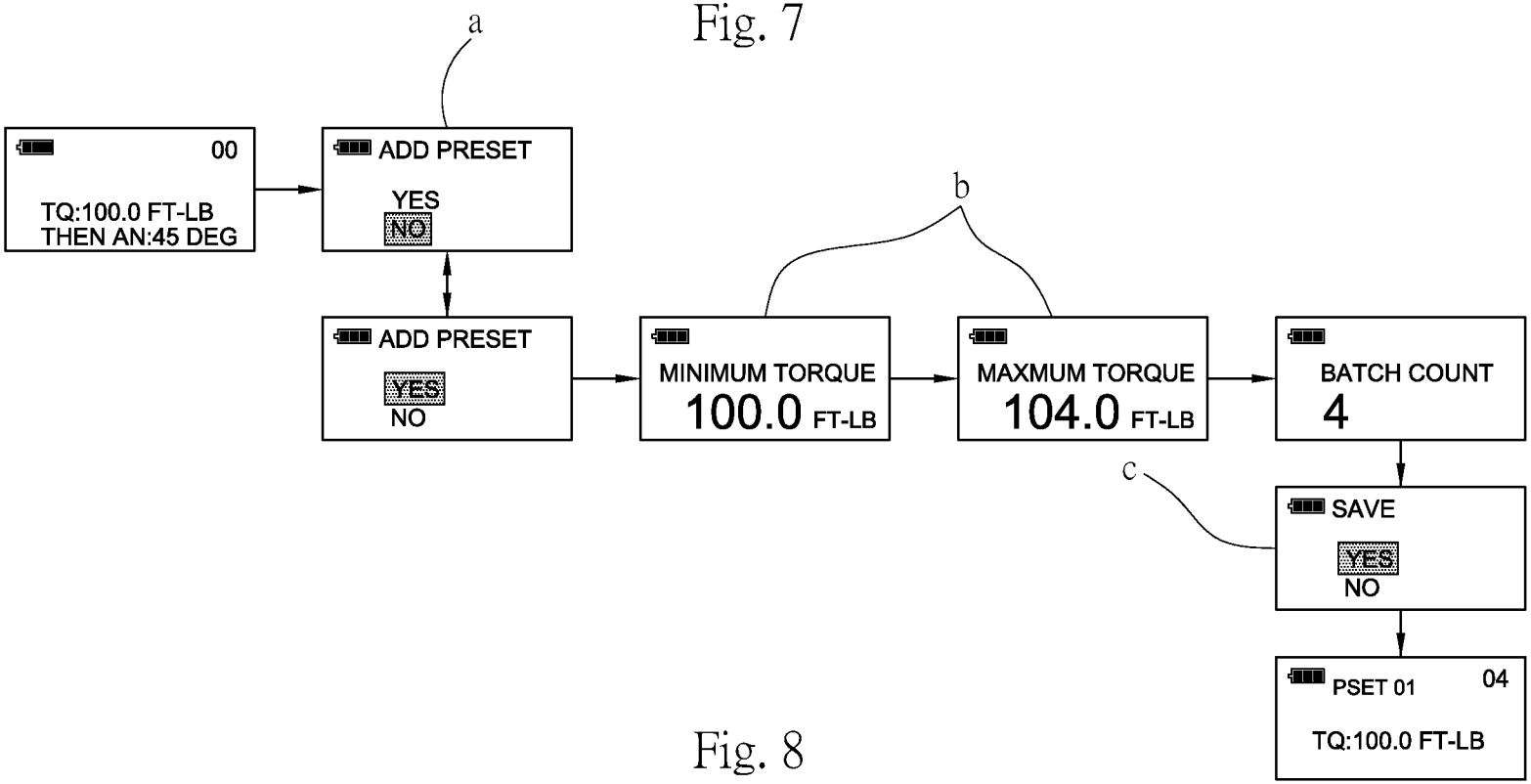
FIG. 8 is a flowchart showing the conventional procedure of adjusting an operation parameter in an operation set.

Referring to FIG. 3 and FIG. 7, the memory unit 23 in this preferred embodiment stores nine operation sets 30. Each operation set 30 includes a set of operation parameters 31 of the torque tool 10, such as the numerical settings 311 for a torque value, for a rotation angle value, and for a torque-then-angle rotation angle value; the units of measurement 312 of the aforesaid values (e.g., a metric unit of measurement and an imperial unit of measurement for the torque value and a unit of measurement for the rotation angle values); and a plurality of mode options 313 (e.g., display mode options (e.g., to display peak values or real-time values) and operation mode options (e.g., to base the operation of the tool body 20 on the torque value, the rotation angle value, or the torque-then-angle rotation angle value)). The operation parameters 31 in each operation set 30 can be adjusted and changed.

By the time the torque tool 10 is shipped from the factory, the operation parameters 31 in all or some of the operation sets 30 may have been preset, so one who intends to use the tool body 20 can rapidly select the one including the desired operation parameters 31 from the default operation sets 30 in the memory unit 23. To facilitate selection, the operation sets 30 are designed to be switched from one to the next by pressing the set button 213, and during the switching process, the display screen 211 will display the operation parameters 31 in each operation set 30 switched to, thereby allowing the user to check through the display screen 211 whether the operation set 30 displayed is the desired one.

Referring to FIG. 3 to FIG. 7, when the operation parameters 31 in a certain operation set 30 need to be adjusted, the adjustment can be carried out through the following steps.

Figure 5:
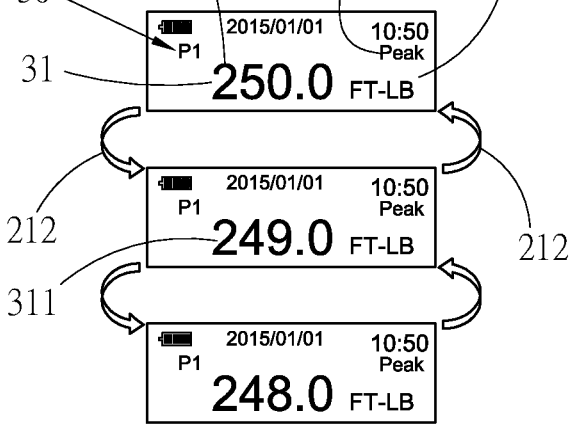
FIG. 5 shows the operations of adjusting a torque value according to the invention.
Figure 6:
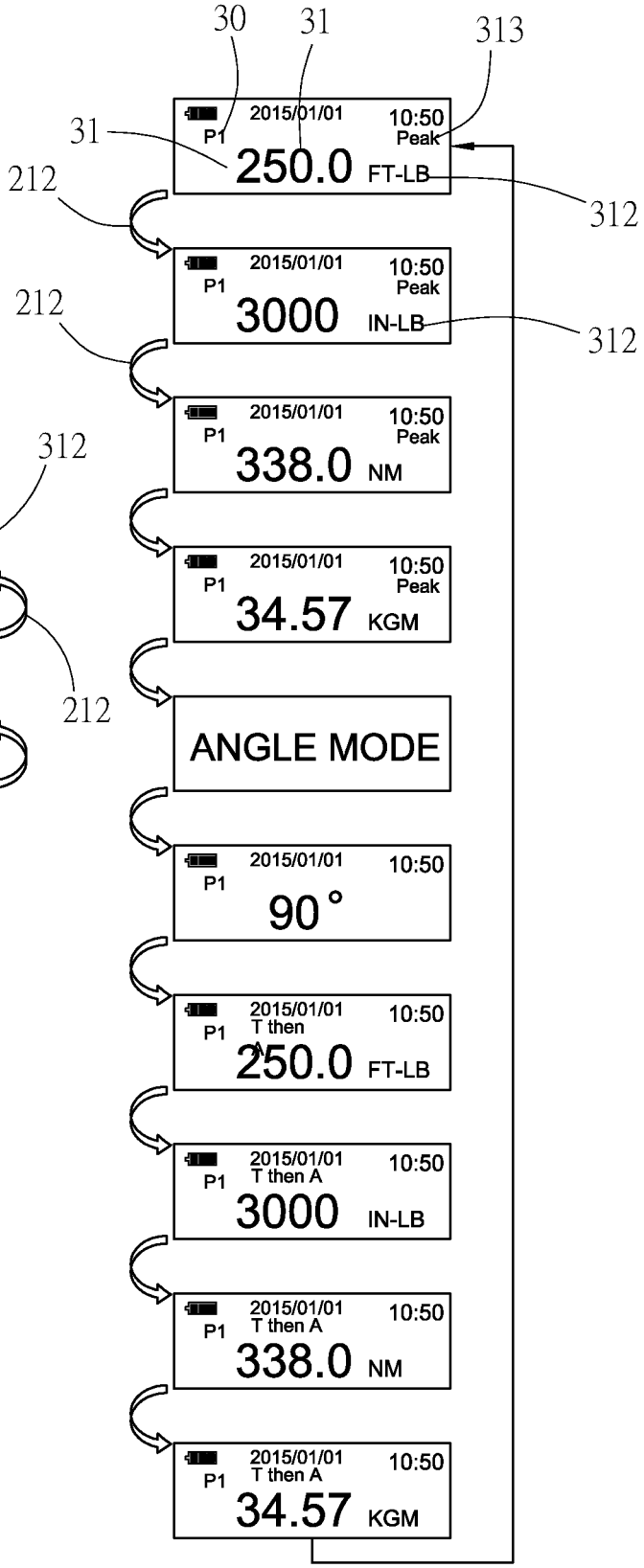
FIG. 6 shows the operations of adjusting the unit of measurement of a torque value and adjusting the detection mode according to the invention.

The first step is a setting step. Referring to FIG. 3, when it is desired to adjust some existing operation parameters 31 or set new operation parameters 31, the adjusting or setting process begins by entering, or selecting, the operation set 30 to which the operation parameters 31 belong. Then, the setting buttons 212 can be pressed while the selected operation set 30 is displayed, in order for the pressed setting buttons 212 to instruct the processing unit 22 to adjust the operation parameters 31 in the set to new values. FIG. 5 to FIG. 7 show how to set or modify different operation parameters 31, such as the numerical setting 311 of a torque value or of a rotation angle value, the unit of measurement 312 of the torque value (metric or imperial) or of the rotation angle value, and the mode option 313 (e.g., an operation mode option or a display mode option).

The setting buttons 212 are configured to instruct the processing unit 22 to adjust whichever operation parameter 31 desired (e.g., the value thereof). The setting buttons 212 may include an upward adjustment button, a downward adjustment button, a unit-of-measurement switching button, and a confirmation button in order to carry out such functions as increasing or decreasing a value, switching between different units of measurement, and confirming the adjustment just made. To adjust the numerical setting 311 of a torque value, the setting buttons 212 can be operated to adjust the torque value and/or the associated angle value to be sensed. To adjust the currently used unit of measurement 312 of a torque or angle value, the setting buttons 212 can be operated to reset the unit of measurement to, for example, NM or KGM in the metric system, FT-LB or IN-LB in the imperial system, or a different unit of angular measurement. To switch to a different mode option 313, the setting buttons 212 can be operated to reset the operation mode of the torque tool 10 (e.g., whether the value to be sensed by the sensing unit 24 is a torque value, a rotation angle value, or a torque-then-angle rotation angle value) or the display mode of the torque tool 10 (e.g., whether the data to be displayed by the display screen 211 (including data that are set to be sensed) should be peak values or real-time values).

Figure 4:
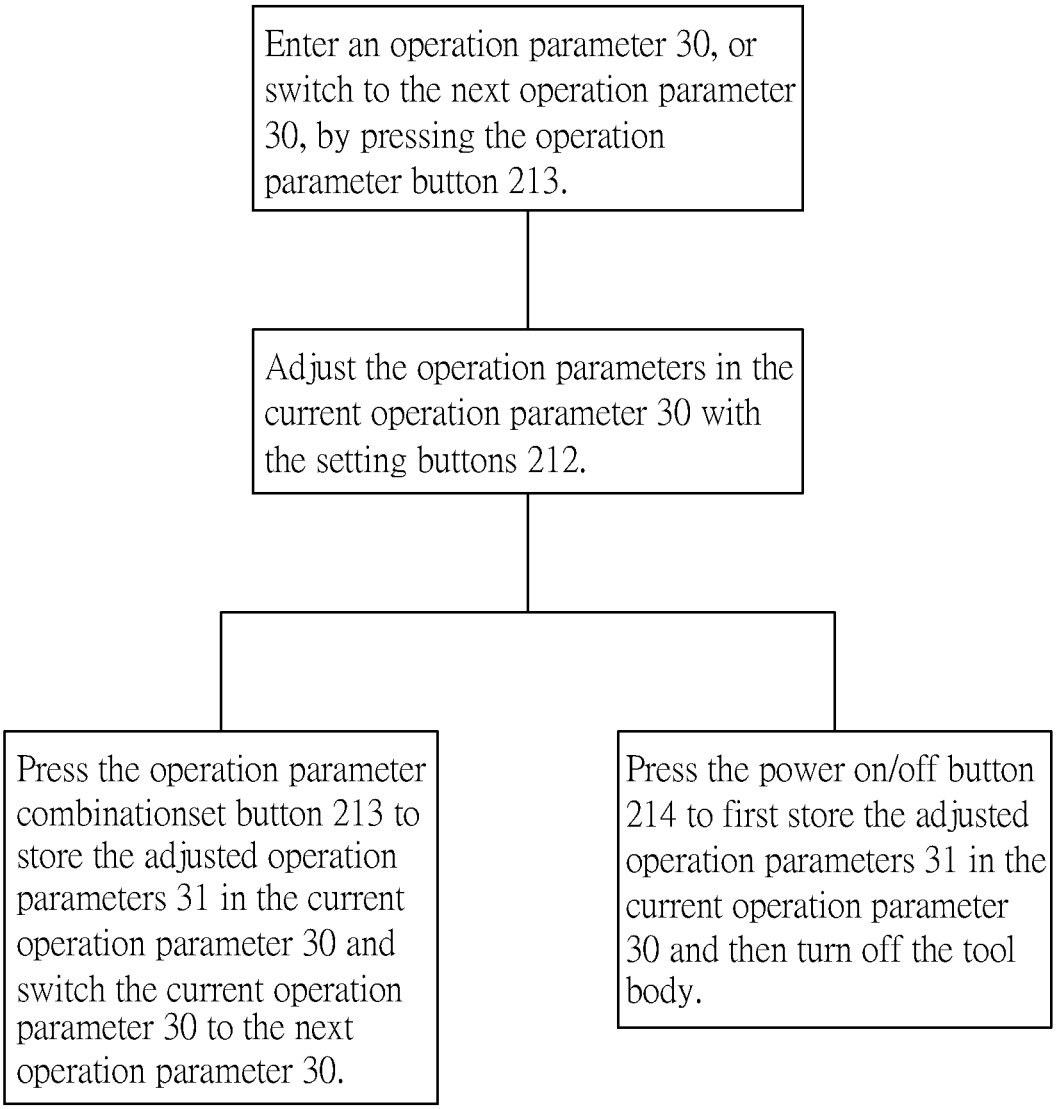
FIG. 4 is a flowchart of the setting step of the invention.

The second step is a storing step. The storing step can be performed immediately after an operation parameter 31 is adjusted or set; in other words, a new operation parameter 31 can be stored without having to wait until all the other operation parameters 31 in the same set are adjusted or set. Referring to FIG. 4, the storage of an operation set 30 can be initiated in two ways: by pressing the set button 213 or the power on/off button 214.

To store the operation set 30 by pressing the set button 213, the set button 213 can be pressed during the setting step whenever an operation parameter 31 has been set, in order for the set button 213 to instruct the processing unit 22 to perform a storing action and thereby store into the memory unit 23 all the operation parameters 31 in the currently displayed operation set 30 that have been adjusted during the setting step. In addition to storing the adjusted operation parameters 31 in the currently displayed operation set 30 directly and automatically, pressing the set button 213 will automatically switch the currently displayed operation set 30 to the next operation set 30. For example, if the user is in the process of setting the operation parameters 31 in the second operation set 30 and presses the set button 213 after a new operation parameter 31 is set, the second operation set 30 will be stored regardless of which operation parameter 31 has been set, and the displayed contents of the display screen 211 will also be switched to the third operation set 30, thereby informing the user that the second operation set 30 has been stored. Moreover, referring to FIG. 7, even if no operation parameter 31 in the currently displayed operation set 30 has been adjusted, pressing the set button 213 will switch the currently displayed operation set 30 to the next, although no operation parameter 31 will be stored.

To store an operation set 30 by pressing the power on/off button 214, the user only has to press the power on/off button 214, and the power on/off button 214 will instruct the processing unit 22 to generate a storage command whereby all the operation parameters 31 in the currently displayed operation set 30 that have been adjusted during the setting step will be directly and automatically stored into the memory unit 23 before the tool body 20 is turned off, and whereby the tool body 20 will be turned off after the contents of the currently displayed operation set 30 are stored into the memory unit 23.

According to the method disclosed herein for setting an electronic torque tool, the setting step can be directly performed while an operation set 30 is displayed, i.e., without having to quit the operation set 30 and conduct further setting elsewhere. This allows the operation parameters 31 to be adjusted with ease, and the unnecessity of activating another interface for more setting enables freer adjustment than achievable with the prior art. Furthermore, a user only has to press a single button (i.e., the set button 213 or the power on/off button 214) when the setting step is being performed on an operation parameter 31 in the currently displayed operation set 30, and all the adjusted operation parameters 31 in the currently displayed operation set 30 will be instantly stored; in other words, the adjusted operation parameters 31 will be directly and automatically stored when the set button 213 or the power on/off button 214 is pressed, without having to go through additional storing steps. This one-button operation is intuitive and convenient, making it easy to store the adjusted operation parameters and hence to use the electronic torque tool. In contrast to the conventional electronic torque wrenches, which must be set through different setting interfaces and will not store an operation set until all the operation parameters in the set have been sequentially set, an electronic torque tool employing the present invention allows the operation parameters in an operation set to be directly adjusted and immediately stored and thus features a user-friendly setting process without the complicated steps of the prior art.

What is claimed is:

1. A setting method for an electronic torque tool, wherein the electronic torque tool comprises a tool body, the tool body stores at least one operation set, the operation set comprises at least one adjustable operation parameter of the electronic torque tool, and the operation parameter in the operation set is adjustable by the setting method, wherein the setting method of the at least one operation parameter of the at least one operation set comprising:

a setting step comprising entering one of said operation set and adjusting said operation parameter in the operation set; and a storing step comprising storing the adjusted operation parameter in the operation set directly when an operator quits the operation set or turns off the electronic torque tool during the setting step.

2. The setting method of claim 1, wherein the operation parameter is a torque value.

3. The setting method of claim 1, wherein the operation parameter is a rotation angle value.

4. The setting method of claim 1, wherein the operation parameter is a rotation angle value of a rotating operation to be performed when a torque value is reached, and both the torque value and the rotation angle value are able to be adjusted.

5. The setting method of claim 1, wherein the tool body stores at least two operation sets.

6. The setting method of claim 5, wherein when the storing step is completed on one of the operation sets, the setting method switches to the next one of the operation sets to perform the setting step.

7. The setting method of claim 6, wherein the electronic torque tool is provided with a plurality of buttons, the storing step is performed by one of the buttons to store the operation parameter of the operation set, and after the storage is completed, the operation set is switched to the next one of operation sets.

8. The setting method of claim 7, wherein the buttons comprise at least one setting button with which to adjust the operation parameter during the setting step.

9. The setting method of claim 7, wherein the buttons comprise a power on/off button with which to turn off the electronic torque tool, and by pressing the power on/off button, the adjusted operation parameter in the operation set is stored and the electronic torque tool is subsequently turned off.

10. The setting method of claim 1, wherein the operation parameter is one of a numerical setting, a unit of measurement, and a mode option; the numerical setting is a torque value or an angle value; the unit of measurement is the unit of measurement of the torque value or of the angle value; and the mode option is an operation mode option or a display mode option.

11. The setting method of claim 7, wherein the buttons comprise a set button, and when the set button is pressed, the adjusted operation parameter in the operation set is stored.

* * * * *